United States Patent [19]

Dammann

[11] Patent Number: 4,549,395

[45] Date of Patent: Oct. 29, 1985

[54] YARN FALSE TWISTING METHOD AND APPARATUS

[75] Inventor: Peter Dammann, Remscheid, Fed. Rep. of Germany

[73] Assignee: Barmag Barmer Maschinenfabrik AG, Remscheid, Fed. Rep. of Germany

[21] Appl. No.: 583,157

[22] Filed: Feb. 24, 1984

[30] Foreign Application Priority Data

Feb. 25, 1983 [DE] Fed. Rep. of Germany ..... 3306580

[51] Int. Cl.[4] ..... D02G 1/08

[52] U.S. Cl. ..... 57/340; 57/339; 57/348

[58] Field of Search ..... 57/334–340, 57/348

[56] References Cited

U.S. PATENT DOCUMENTS

| | | | |
|---|---|---|---|
| 4,339,915 | 7/1982 | Dammann et al. | 57/339 |
| 4,370,853 | 2/1983 | Bauer et al. | 57/339 X |
| 4,391,091 | 7/1983 | Lorenz | 57/340 |
| 4,408,449 | 10/1983 | Bauer et al. | 57/339 X |

*Primary Examiner*—John Petrakes

*Attorney, Agent, or Firm*—Bell, Seltzer, Park & Gibson

[57] ABSTRACT

A yarn false twisting method and apparatus is disclosed, and which includes a pair of oppositely rotating friction discs which are mounted with opposing faces to define a twisting zone therebetween. The yarn is advanced through the twisting zone to impart twist to the yarn in one direction, and the advancing yarn is deflected downstream of the discs so that the yarn is brought into frictional contact with the peripheral edge of one of the discs, to thereby impart an opposite twist to the yarn. The invention is useful in that it permits increased running speed and twist level, and the resulting yarn may be characterized by reduced instances of "tight spots" and less fuzziness resulting from filament breaks.

15 Claims, 5 Drawing Figures

YARN FALSE TWISTING METHOD AND APPARATUS

The present invention relates to a method and apparatus for false twisting an advancing yarn in a false twist texturing operation or the like.

U.S. Pat. No. 4,339,915 to Dammann et al discloses an apparatus for false twisting a yarn which comprises a pair of rotatable discs mounted to define a twisting zone between opposing friction surfaces thereof. One of the discs is flexible, and will readily flex in the lateral direction upon application of a lateral bending force. For the purpose of nipping a yarn as it is advanced through the twisting zone, there is provided a pressure applying member adjacent the back face of the flexible disc for laterally biasing the flexible disc toward the other disc locally at the twisting zone.

U.S. pending application Ser. No. 492,241 to Schippers, now U.S. Pat. No. 4,519,203, discloses a method and apparatus for twisting a yarn, in such a manner as to produce a torque free yarn in a false twist texturing operation or the like. In particular, the above application disclose two circular discs, with at least one of the discs being flexible, and two separate pressure applying members mounted adjacent the back surface of the flexible disc, with the two members being positioned on opposite sides of the plane defined by the axes of rotation of the discs. The two pressure applying members are adapted to be actuated concurrently, so that one member defines a first twisting zone wherein S twist is imparted to the adancing yarn, and the other member defines a second twisting zone wherein Z twist is imparted to the yarn.

While the use of a second pressure applying member as described in the above application is useful in producing a torque free yarn, the second member adds to the initial cost of the apparatus, and it also results in additional cost during operation and service of the apparatus.

It is accordingly an object of the present invention to provide a method and apparatus for imparting a second, opposite false twist following the insertion of a first false twist in a false twist texturing operation or the like, and which is of simple and inexpensive construction.

It is a more specific object of the present invention to provide a yarn false twisting method and apparatus of the described type which is adapted for operation at relatively high yarn speeds and twist levels, without impairing the yarn quality by reason of tight spots or yarn fuzziness.

These and other objects and advantages of the present invention are achieved in the embodiment described herein by the provision of a yarn false twisting method and apparatus which comprises a pair of twist imparting members, with both of the members having a yarn engaging friction surface, and at least one of the members comprising a circular disc. The members are mounted for rotation so that the yarn engaging friction surfaces are disposed in opposing, face to face relationship and define a twisting zone therebetween, and such that the friction surfaces run in different directions through the twisting zone. Further, means are provided for guiding an advancing yarn through the twisting zone, and which includes a yarn guide positioned downstream of the members for laterally deflecting the advancing yarn so that the yarn is brought into frictional contact with the peripheral edge of the disc, to thereby impart twist to the yarn in a direction opposite to that imparted at the twisting zone. In one preferred embodiment, both of the twist imparting members comprise a circular disc, with the discs being mounted for rotation about parallel spaced apart axis. Also, the yarn guide is mounted on one side of the plane defined between the opposing faces of the discs, and so that the yarn is deflected at an angle of between about 3 to 15 degrees with respect to the plane defined between the opposing faces of the discs.

Some of the objects having been stated, other objects and advantages of the invention will appear as the description proceeds, when taken in connection with the accompanying drawings, in which FIG. 1 is a front elevation view of a yarn twisting apparatus embodying the features of the present invention;

Figure 1:
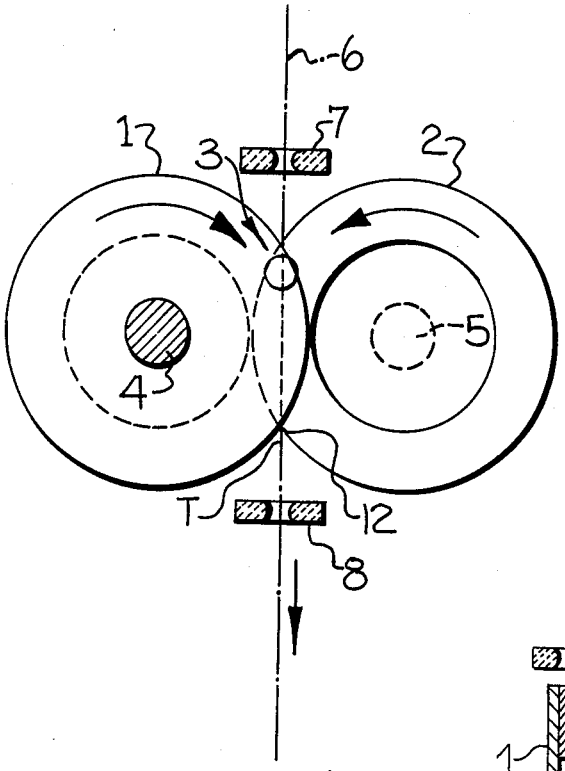

Referring more particularly to the drawings, FIG. 1 shows a friction false twist apparatus according to the invention, and which comprises tow circular discs 1 and 2, of which the disc 1 is relatively thin and readily flexible material, but which can absorb high tension forces. In the illustrated embodiment, the disc 2 is substantially rigid and non-yieldings, and each of the discs includes a yarn engaging friction surface on one face thereof, with the friction surface being defined by an annular friction coating adjacent the outside peripheral edge.

The two discs 1 and 2 are mounted on shafts 4 and 5, respectively, with the shafts being mounted for rotation about substantially parallel spaced apart axes such that portions of the respective yarn engaging friction surfaces are disposed in opposing face to face relationship and define a twisting zone therebetween which is located at a point laterally spaced from the plane defined by the axes of rotation of the shafts 4 and 5. Conventional drive means is also provided for rotating the discs in opposite rotational directions, such that their respective yarn engaging friction surfaces run in different directions through the twisting zone.

Disc impingement means in the form of a pressure applying member 3 is operatively positioned adjacent the face of the flexible disc 1 opposite its yarn engaging friction surface, for applying a force to such face which is aligned with the twisting zone and so as to bias the flexible disc toward the other disc locally at the twisting zone. As illustrated, the pressure applying member 3 comprises a piston 9 which is biased forwardly into contact with the disc 1 by a spring 10.

Figure 2:
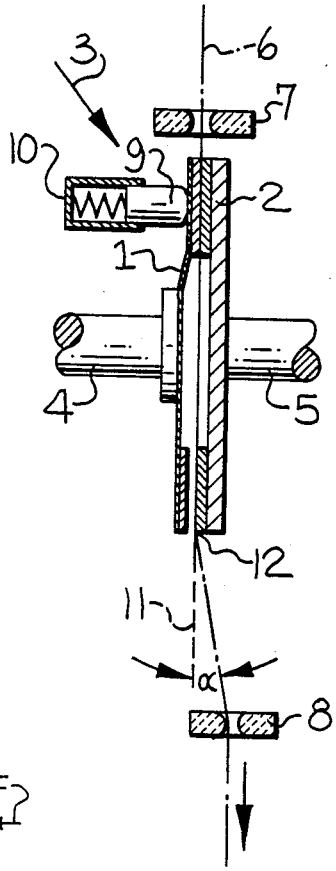
FIG. 2 is a sectional side elevation view of the apparatus shown in FIG. 1.

Yarn guides 7 and 8 are also provided for guiding an advancing yarn 6 through the twisting zone in a direction generally perpendicular to the plane defined by the disc axes of rotation, so as to have twist imparted thereto at the twisting zone by frictional contact between the yarn and the respective opposed friction surfaces. Otherwise, the yarn travels essentially freely between the opposing faces to the two discs. The downstream yarn guide 8 is mounted on one side of the plane 11 defined between the opposing faces of the discs, and this offset mounting of the guide 8 acts to laterally deflect the advancing yarn so that the yarn is brought into frictional contact with the peripheral edge 12 of the disc 2 at a point on the side of the plane defined by the disc axes of rotation opposite that of the twisting zone. Stated in other words, the twisting zone is disposed above the plane of the axes of rotation as shown in FIG. 1, and the point at which the yarn contacts the peripheral edge 12 is below such plane. As best seen in FIG. 2, the offset mounting of the yarn guide 8 causes the yarn to form a deflection angle alpha with respect to the plane 11, which can also be described as the looping angle of the yarn over the outer edge of the rigid disc 2.

Figure 4:
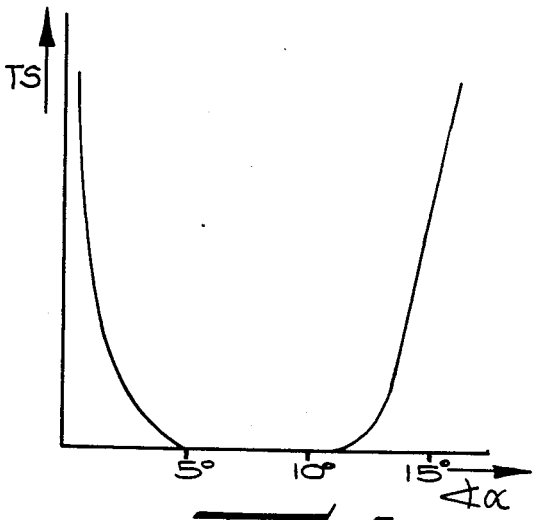
FIG. 4 is a diagram illustrating the influence of the looping angle alpha on the number of tight spots.

By reason of the rotational direction of the disc 2, the yarn 6 receives a twist from its frictional contact with the peripheral edge 12 of the disc 2, and such twist will tend to return upstream to the area of the pressure applying member 3. Also, the direction of twist imparted by the peripheral edge 12 is opposite to the twist which is imparted to the yarn by the pressure applying member 3 at the twisting zone. It may be assumed that the twist imparted by the edge 12 will tend to remove tight spots formed in the advancing yarn, but it has been found that one cannot safely rely on this removal of tight spots, since, as shown in the diagram of FIG. 4 (which involves the processing of a 167 dtex yarn), the number of tight spots first decreases with an increasing deflection angle alpha, and reaches its lowest value approximately in the area of an angle alpha of 5 degrees. However, upon the angle alpha exceeding a predetermined amount (about 12 degrees), the number of tight spots again increases. Since one may assume that the amount of twist insertion increases as the deflection angle alpha increases, the interrelation between twist insertion and number of tight spots may be determined from this diagram for various possible deflection angles when the indicated yarn is being processed. In most instances, the deflection angle should be between about 3 and 15 degrees, and preferably between about 5 and 10 degrees.

Figure 3:
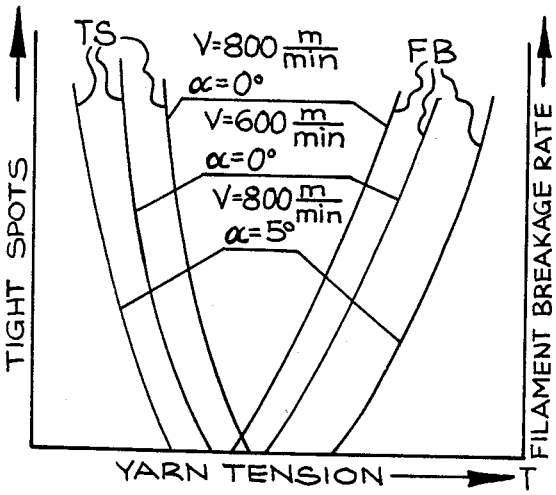
FIG. 3 is a diagram illustrating the influence of yarn tension in the region downstream of the false twisting apparatus on the number of tight spots and fuzziness.

During the operation of friction false twisting apparatus, the operating range is limited in that both the number of tight spots and the fuzziness (filament breaks) are dependent on the speed. As illustrated in the diagram of FIG. 3, the number of tight spots can be reduced by increasing the tension T of the yarn after its passage through the friction false twisting apparatus, but the fuzziness becomes greater as the tension T increases. In the case of a 167 dtex polyester yarn, the diagram of FIG. 3 shows that at a yarn speed of 600 m/min, a yarn tension range can be set in which neither tight spots nor filament breaks occur at a disturbing frequency. The diagram further shows that when the yarn speed is increased to 800 m/min, such a yarn tension range no longer exists. Where however, a deflection angle alpha is established in accordance with the present invention, it is found that both the number of tight spots and filament breakage rate are adjusted so that there exists again a clear range of the yarn tension in which the operation may proceed without incurring a disturbing number of tight spots or filament breaks.

In a conventional false twist texturing operation, it may be observed that tight spots and filament breaks both occur, and one can conclude that tight spots may be removed by applying tension forces which act upon the filaments, and that tight spots will remain when these forces which are exerted on individual filaments cannot be absorbed by the filaments causing them to break. According to the present invention, the yarn is deflected at the outlet of the false twisting apparatus, which results in tight spots being removed without having to apply forces to the filaments which may lead to a breakage of the filaments.

Figure 2A:
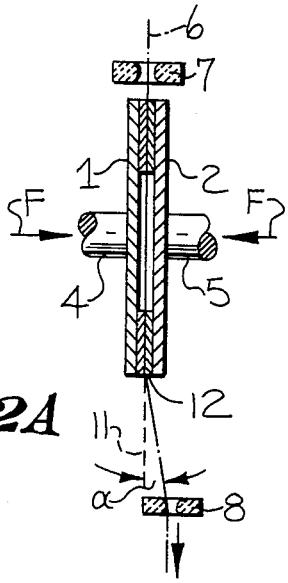
FIG. 2A is a sectional side elevation view of a second embodiment of the invention.

FIG. 2A illustrates a second embodiment of the invention, and wherein both of the discs 1 and 2 are substantially rigid and non-yielding. Preferably, this embodiment also includes suitable spring biasing means (illustrated schematically to the arrows F) for biasing the discs toward each other at the twisting zone.

While the embodiments of the invention specifically described above the utilize two circular discs as the twist imparting members, it will be understood that the invention is also applicable to a false twisting apparatus wherein only one of the twist imparting members comprises a circular disc and the other member comprises a rotatable back-up roller or the like. An example of an apparatus of this construction is illustrated in FIGS. 5 and 6 of the U.S. Pat. to Dammann et al, No. 4,339,915, the disclosure of which is expressly incorporated herein by reference. In such embodiment, the disc is preferably relatively rigid, and the downstream yarn guide is positioned so as to laterally deflect the advancing yarn so that the yarn is brought into frictional contact with the peripheral edge of the disc at a point on the side of the disc generally opposite the twisting zone, to thereby impart twist to the yarn in a direction opposite to that imparted at the twisting zone.

In the drawings and specification, there has been set forth preferred embodiments of the invention, and although specific terms are employed, they are used in a generic and descriptive sense only and not for purposes of limitation.

That which is claimed is:

1. A method of false twisting yarn which comprises the steps of operatively rotating a pair of twist imparting members, with each member including a yarn engaging friction surface, and at least one of said members comprising a circular disc, and such that portions of the respective yarn engaging friction surfaces are disposed in opposing, fact-to-face relationship and define a twisting zone therebetween, while advancing a yarn through said twisting zone so that twist is imparted thereto by the frictional contact between the yarn and the respective opposed friction surfaces, and including laterally deflecting the advancing yarn at a point downstream of said disc and in a direction generally perpendicular to the plane defined by the yarn engaging friction surface of said disc, and so as to form an angle of between about 3 to 15 degrees with respect to such plane, and such that the yarn is brought into frictional contact with the peripheral edge of said disc at a point on the side of said disc generally opposite twisting zone, to thereby impart twist to the yarn in a direction opposite to that imparted at said twisting zone.

2. A method of false twisting yarn which comprises the steps of operatively rotating a pair of twist imparting circular discs in opposite rotational directions about generally parallel spaced apart axes, with each disc including a yarn engaging friction surface, and such that portions of the respective yarn engaging friction surfaces are disposed in opposing, face to face relationship and define a twisting zone therebetween which is located at a point laterally spaced from the plane defined by said disc axes of rotation, while advancing a yarn through said twisting zone along a path extending generally perpendicular to the plane defined by said axes of rotation and between the axes of rotation, so that twist is imparted thereto by the frictional contact between the yarn and the respective opposed friction surfaces which results from the applied force, and while laterally deflecting the advancing yarn after leaving the rotating discs at a point downstream of said discs and in a direction generally perpendicular to the plane defined between the opposing faces of the discs and at an angle of between about 3 to 15 degrees with respect to said plane, and so that the yarn is brought into frictional contact with the peripheral edge of one of said discs at a point on the side of said plane defined by the axes of rotation opposite the twisting zone, to thereby impart twist to the yarn in a direction opposite to that imparted at said twisting zone.

3. The method as defined in claim 2 wherein one of said discs is relatively thin and flexible and the other of said discs is substantially rigid and non-yielding, and comprising the further step of contacting the face of said flexible disc opposite its yarn engaging friction surface and at a location aligned with said twisting zone so as to bias said flexible disc toward the other disc locally at said twisting zone.

4. The method as defined in claim 2 comprising the further step of applying a predetermined tension to the yarn leaving the twist imparting discs, with the tension force being calculated to minimize both tight spots and yarn filament breaks.

5. The method as defined in claim 2 comprising the further step of applying a force at a location with respect to said twist imparting discs to effect biasing of said discs toward each other at said twisting zone.

6. The method as defined in claim 5 wherein the step of applying a force to effect biasing of said discs toward each other includes contacting the face of one of said discs opposite its yarn engaging friction surface and at a location aligned with said twisting zone so as to bias said one disc toward the other disc locally at said twisting zone.

7. A yarn false twisting apparatus comprising a pair of twist imparting members, one of said members comprising a circular disc having a yarn engaging friction surface on one face thereof, and the other of said members having a yarn engaging friction surface, means mounting said members for rotational movement wherein portions of the respective yarn engaging friction surfaces are disposed in opposing, face-to-face relationship and define a twisting zone therebetween, means for rotating said members such that their respective yarn engaging friction surfaces run in different directions through said twisting zone, and means for guiding an advancing yarn through said twisting zone so as to have twist imparted thereto at said twisting zone by frictional contact between the yarn and the respective opposed friction surfaces, and including yarn guide means positioned downstream of said disc for laterally deflecting the advancing yarn at an angle of between about 3 to 15 degrees with respect to the plane defined by the yarn engaging friction surface of said circular disc, and so that the yarn is brought into frictional contact with the peripheral edge of said disc at a point on the side of said disc generally opposite said twisting zone, to thereby impart twist to the yarn in a direction opposite to that imparted at said twisting zone.

8. The yarn false twisting apparatus as defined in claim 7 wherein said circular disc is relatively rigid.

9. A yarn false twisting apparatus comprising a pair of twist imparting circular discs, with each disc including a yarn engaging friction surface, means rotatably mounting said discs for rotation about substantially parallel spaced apart axes such that portions of the respective yarn engaging friction surfaces are disposed in opposing face to face relationship and define a twisting zone therebetween which is located at a point laterally spaced from the plane defined by the disc axes of rotation, means for rotating the discs in opposite rotational directions such that their respective yarn engaging friction surfaces run in different directions through said twisting zone, and means for guiding an advancing yarn through said twisting zone in a direction generally perpendicular to the plane defined by said disc axes of rotation so as to have twist imparted thereto at said twisting zone by frictional contact between the yarn and the respective opposed friction surfaces, and including yarn guide means positioned downstream of said discs for laterally deflecting the advancing yarn at an angle of between about 3 to 15 degrees with respect to the plane defined between the opposing faces to said discs, and so that the yarn is brought into frictional contact with the peripheral edge of one of said discs at a point on the side of said plane defined by the disc axes of rotation opposite said twisting zone, to thereby impart twist to the yarn in a direction opposite to that imparted at said twisting zone.

10. The yarn false twisting apparatus as defined in claim 9 wherein said yarn guide means comprises a yarn guide mounted downstream of said discs and on one side of the plane defined between the opposing faces of said discs.

11. The yarn false twisting apparatus as defined in claim 10 further comprising means operatively positioned with respect to said discs for applying a force to effect biasing of said discs toward each other at said twisting zone.

12. The yarn false twisting apparatus as defined in claim 11 wherein one of said discs is relatively thin and flexible, and the other of said discs is substantially rigid and non-yielding.

13. The yarn false twisting apparatus as defined in claim 12 wherein said means for applying a force to effect biasing of said discs toward each other at said twisting zone comprises disc impingement means operatively positioned adjacent the face of said flexible disc opposite its yarn engaging friction surface for applying a force to said face which is aligned with said twisting zone and so as to bias said flexible disc toward the other disc locally at said twisting zone.

14. The yarn false twisting apparatus as defined in claim 13 wherein said downstream yarn guide is mounted so as to deflect the yarn into frictional contact with the peripheral edge of said rigid disc.

15. The yarn false twisting apparatus as defined in claim 10 wherein both of said discs are substantially rigid and non-yielding.

* * * * *